US006733427B1

(12) United States Patent
He

(10) Patent No.: US 6,733,427 B1
(45) Date of Patent: May 11, 2004

(54) RESILIENT EXERCISE HOOP

(76) Inventor: Wen-Yu He, No. 20, Alley 34, Lane 476, Tung Ping Rd., Tai Ping, Taichung Hsien (TW)

( * ) Notice: Subject to any disclaimer, the term of this patent is extended or adjusted under 35 U.S.C. 154(b) by 0 days.

(21) Appl. No.: 10/393,009

(22) Filed: Mar. 21, 2003

(51) Int. Cl.[7] ..... A63B 21/02
(52) U.S. Cl. ..... 482/122; 482/126; 482/121
(58) Field of Search ..... 482/126, 44, 122, 482/139, 149, 110, 128

(56) References Cited

U.S. PATENT DOCUMENTS 3,460,829 A * 8/1969 Roggero
4,645,197 A * 2/1987 McFee
4,750,734 A * 6/1988 Greenfield
5,016,874 A * 5/1991 Boardman
5,342,273 A * 8/1994 Plendl et al.
5,735,781 A * 4/1998 Pai
5,807,217 A * 9/1998 Endelman
5,911,535 A * 6/1999 Gvoich

* cited by examiner

*Primary Examiner*—Jerome W. Donnelly
(74) *Attorney, Agent, or Firm*—Browdy and Neimark, P.L.L.C.

(57) ABSTRACT

A resilient exercise hoop includes a resilient hoop body, two pressing members, and a resistance member. The resilient hoop body is circular in shape but deformed to be elliptic while pressed by an external force. While the external force is eliminated, the hoop body will recover the circular shape. The two pressing members face in opposite directions for pressing by the user to deform the resilient hoop body. The resistance member has two ends, which are respectively connected to two predetermined opposite sides of the resilient hoop body, with resilience for resisting the two opposite sides of the hoop body from outward extension and deformation. In addition, the resilience of the resistance can be variated by the user.

2 Claims, 4 Drawing Sheets

RESILIENT EXERCISE HOOP

BACKGROUND OF THE INVENTION

1. Field of the Invention

The present invention relates generally to exercise apparatuses, and more particularly to a resilient exercise hoop.

2. Description of the Related Art

As shown in FIG. 6, a conventional resilient exercise hoop 80 is composed of a resilient bar 81, which is formed of an elongated glass fiber or an elongated metal band. The resilient bar 81 is curved to be circular and is fastened with two pressing members 82 and 83 at two sides thereof so as to be pressed by each part of the human body. While the exercise hoop 80 is pressed by a force, the hoop will be elastically deformed to have a potential energy of resilience. And then, while the force is eliminated, the hoop will recover itself by means of the potential energy. However, the user fails to variate the pressure intensity of the conventional exercise hoop pressed by the force such that the hoop 80 doesn't fit people of various ages and different portions of the human body. Therefore, an improvement to eliminate the aforesaid drawback is necessary.

SUMMARY OF THE INVENTION

The primary objective of the present invention is to provide a resilient exercise hoop, which enables the user to variate the resistance against its deformation, namely, which provides a variety of difficulties for operating the exercise hoop, thereby in coordination with different users or different portions of the human body or difference exercise postures.

The foregoing objective of the present invention is attained by the resilient exercise hoop, which is composed of a resilient hoop body, two pressing members, and a resistance member. The resilient hoop body is circular in shape but deformed to be elliptic while pressed by an external force. While the external force is eliminated, the hoop body will recover the circular shape. The two pressing members face in opposite directions for pressing by the user to deform the resilient hoop body. The resistance member has two ends, which are respectively connected to two predetermined opposite sides of the resilient hoop body, with resilience for resisting the two opposite sides of the hoop body from outward extension and deformation. In addition, the resilience of the resistance can be variated by the user. The resilient hoop body is connected with the resistance member substantially respectively at a central position thereof between the two pressing members.

DETAILED DESCRIPTION OF THE INVENTION

Figure 1:
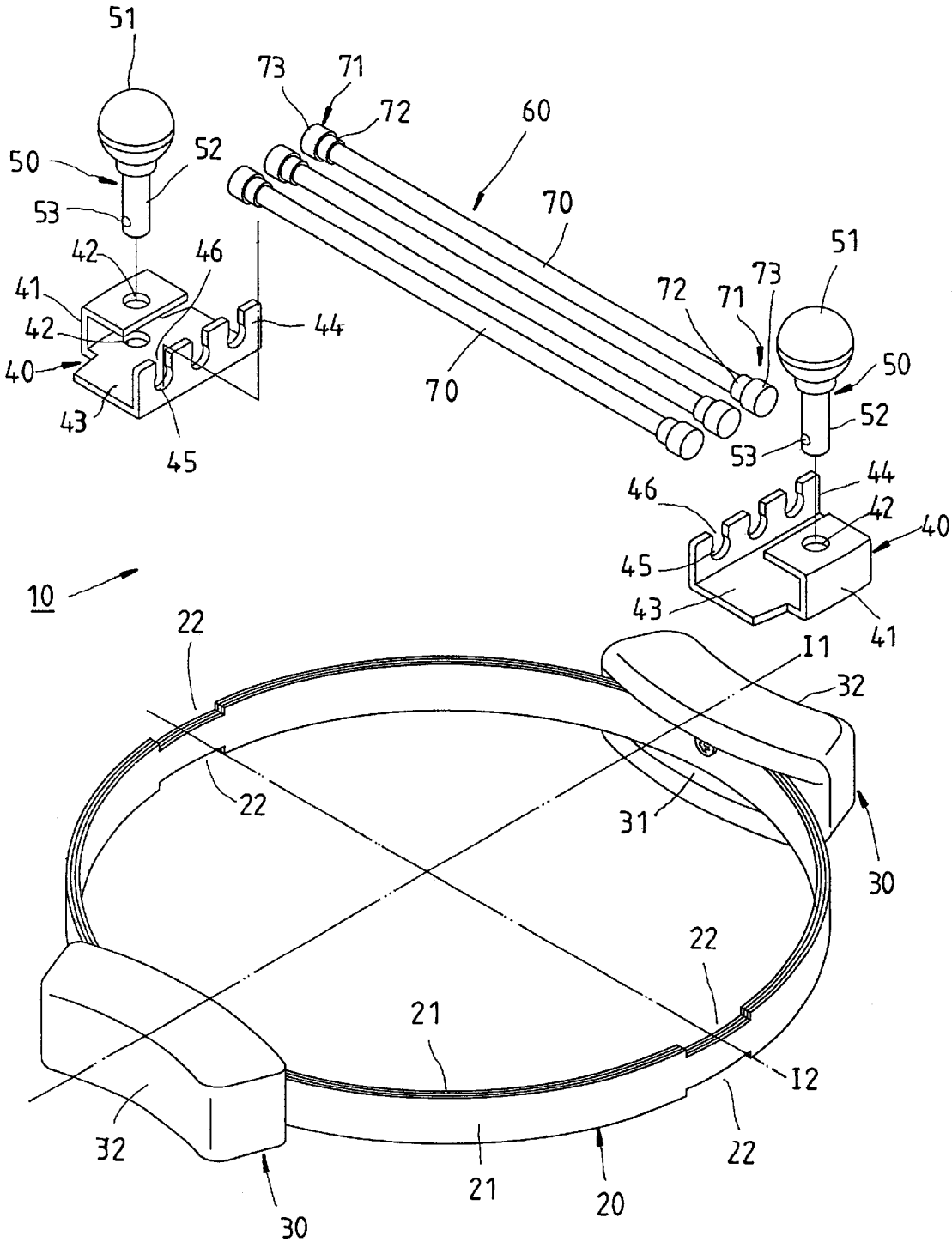
FIG. 1 is an exploded view of a preferred embodiment of the present invention.
Figure 2:
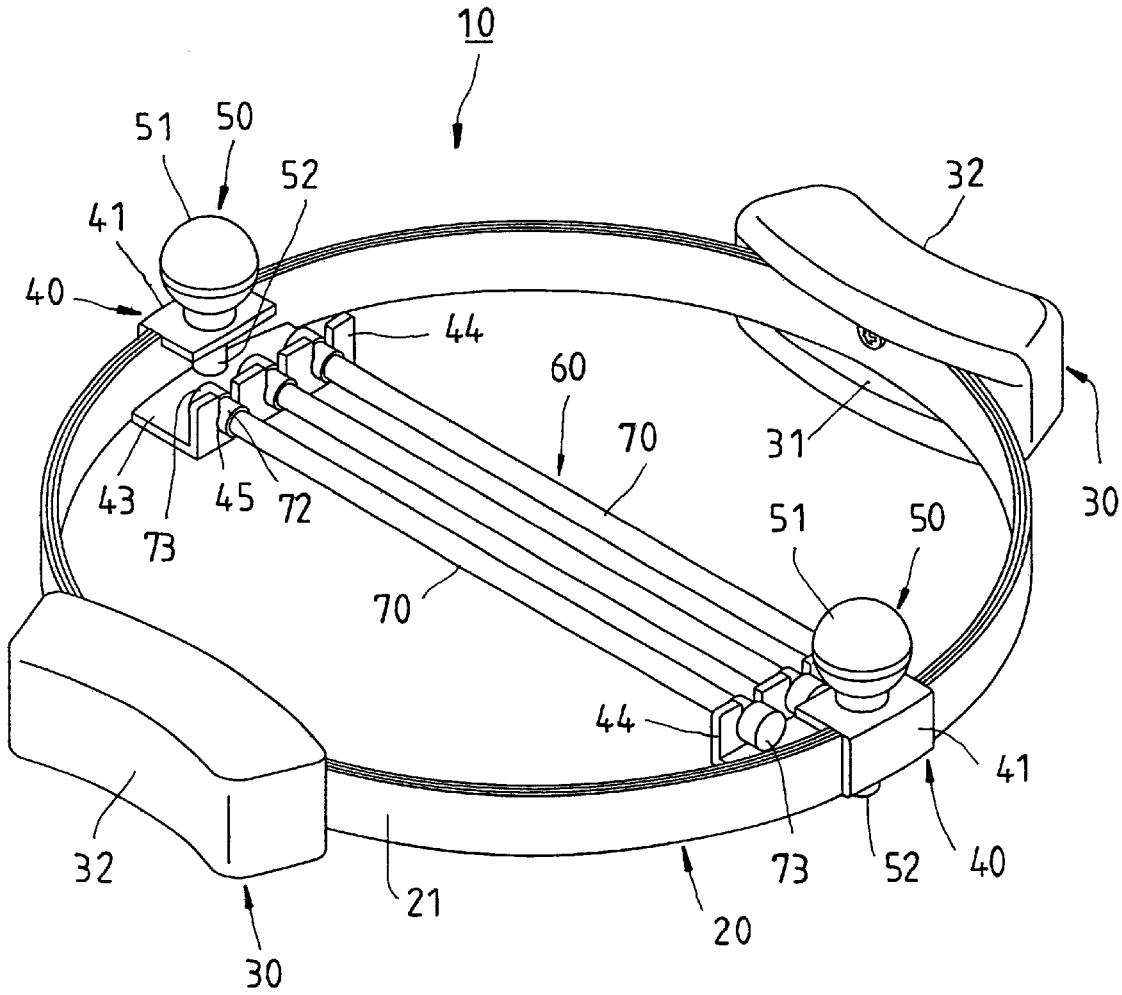
FIG. 2 is a perspective view of the preferred embodiment of the present invention.

Referring to FIGS. 1~4, an exercise hoop 10 of a preferred embodiment of the present invention is composed of a resilient hoop body 20, two pressing members 30, two connection seats 40, two fastening members 50, and a resistance member 60.

The resilient hoop body 20 is formed of three metal bands 21, which are evenly overlapped and which two ends are connected with each another. The hoop body 20 is circular in shape under no external force and will be deformed to be elliptic in shape while an external force is exerted on two opposite sides thereof, and meanwhile, a resilience provided by the hoop body 20 resists the external force. While the external force is eliminated, the hoop body will recover the circular shape by the resilience. The hoop body 20 is provided with four indents 22, each two (hereafter referred to as a pair of indents) of which are positioned at a lateral fringe of the metal bands 21.

Each of the pressing members 30 is an arched elongated block and includes a trench 31 extending transversally at a convex side thereof and a pressing portion 32 at a concave side thereof The two pressing members 30 are mounted to two opposite sides of the resilient hoop body 20 and each of which is positioned at the center of the hoop body 20 between the two pair of indents. In other words, a first imaginary line I1 connected between the two pressing members 30 is normal to a second imaginary line I2 connected between the two pairs of indents 22. The two pressing members 30 are respectively threadedly mounted to the two opposite sides of the hoop body 20 at the trenches 31 facing to each other by screws, such that the two pressing portions 32 face in opposite directions for pressing by a predetermined portion of the user's body, such as hands or knees.

Each of the connection seats 40 includes a U-shaped clamping member 41, which is provided at two opposite sides thereof with two through holes 42 communicating with and corresponding in location to each other. The clamping member 41 has an extension plate 43 extending outwards from a side thereof and a hook plate 44 extending from a distal end of the extension plate 43 and being normal to the extension plate 43. The hook plate 44 is provided with three circular positioning holes 45 in alignment with one another, and three gaps 46 positioned at the edge thereof and respectively communicating with the three positioning holes 45. The width of each the gap 46 is slightly smaller than the diameter of the positioning hole 45. The two connection seats 40 are respectively fitted to and fixedly engaged with the two pairs of the indents 22 of the hoop body 20 at the clamping members 41 thereof so as to be prevented from slipping around the hoop body 20.

Figure 4:
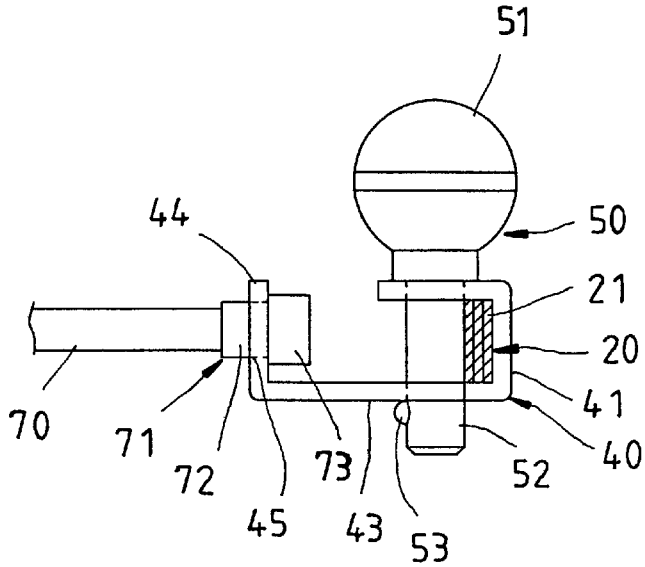
FIG. 4 is a sectional view taken along a line 4—4 indicated in FIG. 3.

Each of the fastening members 50 is provided with a spherical head portion 51, a body portion 52 extending outwards from a side of the head potion 51, and a locking piece 53 positioned inside a distal end of the body portion 52. The diameter of the body portion 52 corresponds to that of the through hole 42 of the connection seat 40. The locking piece 53, which is a prior art, keeps exposed outside of the body portion 52 and in shape of a granule by its own resilience, and while the locking piece 53 is pressed by an external force, the locking piece 53 will be pressed inside the body portion 52. Referring to FIG. 4, the fastening member 50 is inserted through the two through holes 42 of the connection seat 40 at the body portion 52, and then engaged against a side of the clamping member 41 at the head portion 51, and fixedly engaged with another side of the clamping member 41 at the locking piece 53. Moreover, the body portion 52 of the fastening members 50 keeps the resilient hoop body 20 (the three metal bands 21) engaged to an inner side of the clamping member 41 such that the connection seat 40 is fixedly mounted to the hoop body 20.

The resistance member 60 is formed of three resilient bars 70 made of resilient rubber or spring. Each of the resilient bars 70 has smaller diameter than the width of the gap 46 of the connection seat 40, and is identical to the distance between the two hook plates 44 of the two connection seats 40 in length. Each resilient bar 70 is provided with an elongated body portion and two head pieces 71 respectively positioned at two distal ends thereof. Each of the head pieces 71 is composed of a neck portion 72 and a head portion 73 extending outwards from a distal end of the neck portion 72, wherein the head portion 73 has larger diameter than that of the neck portion 72. In addition, the neck portion 72 has substantially isometric diameter with that of the positioning hole 45 of the connection seat 40 and slightly larger diameter than the width of the gap 46. To connect the resilient bars 70 to the two connection seats 40 of the resilient hoop body 20, first, a first end of each the resilient bar 70 is inserted through the gap 46 and into the positioning hole 45 at a position thereof in proximity of the head piece 71. Second, the resilient bar 70 is pulled toward a second end thereof such that the neck portion 72 of the head piece 71 is moved axially to be engaged into the positioning hole 45, and the head portion 73 of the head piece 71 is engaged against an inner side of the hook plate 44 of the connection seat 40, thereby preventing the first end of the resilient bar 70 from running away toward the gap 46. Finally, the second end of the resilient bar 70 is slightly elastically extended and then connected with the other connection seat 40 by means of the aforementioned procedure. Because the resilient bars 70 are provided with predetermined resilience and length, the two ends of each the resilient bar 70 are fixedly connected with the two connection seats 40, namely, the resilient bars 70 are connected between two opposite sides of the hoop body 20.

Figure 3:
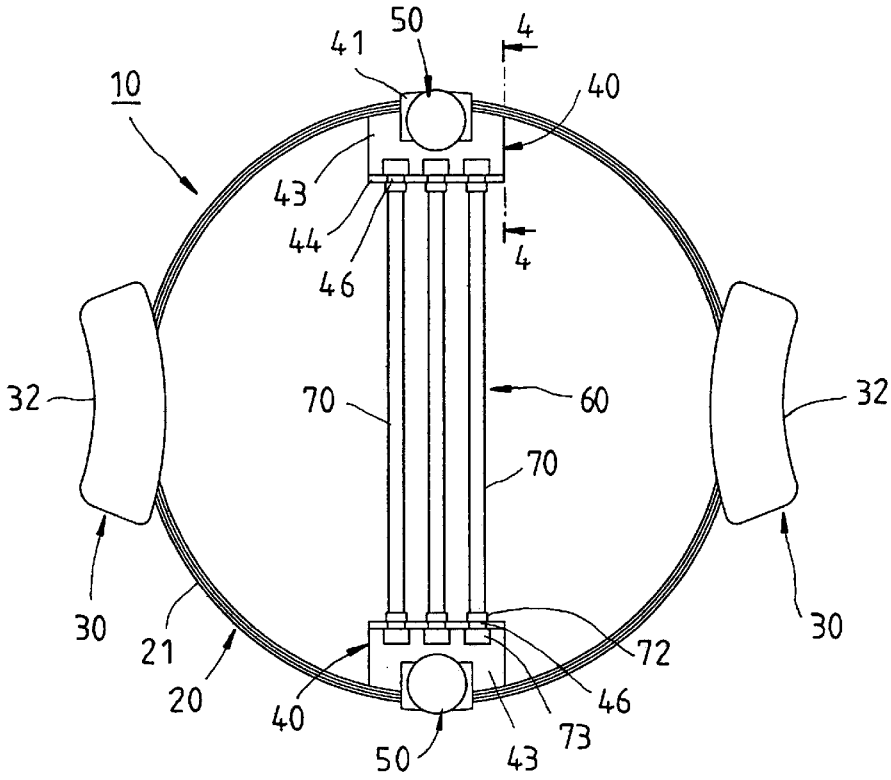
FIG. 3 is a plan view of the preferred embodiment of the present invention under no external force.
Figure 5:
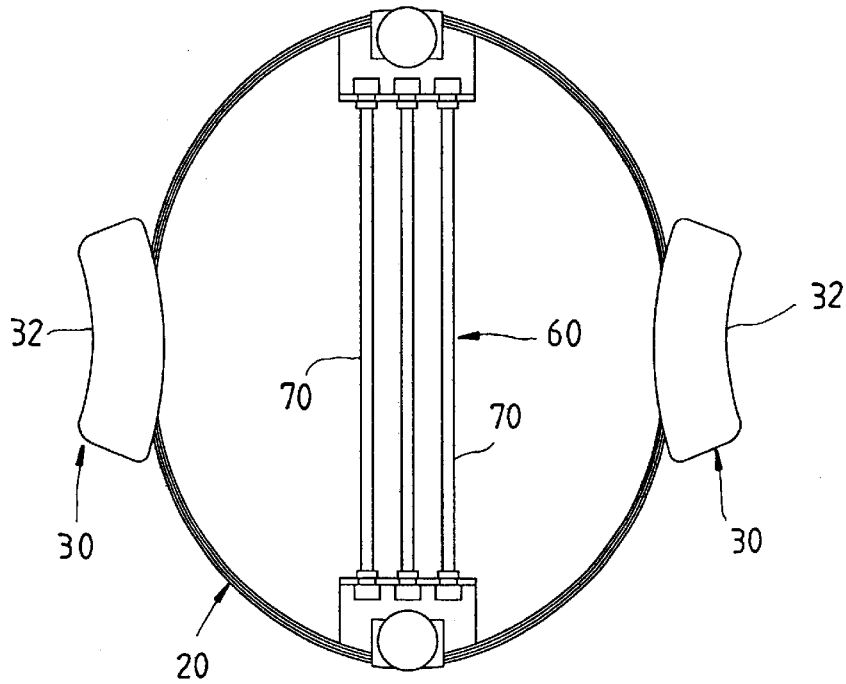
FIG. 5 is a plan view of the preferred embodiment of the present invention under an external force.
Figure 6:
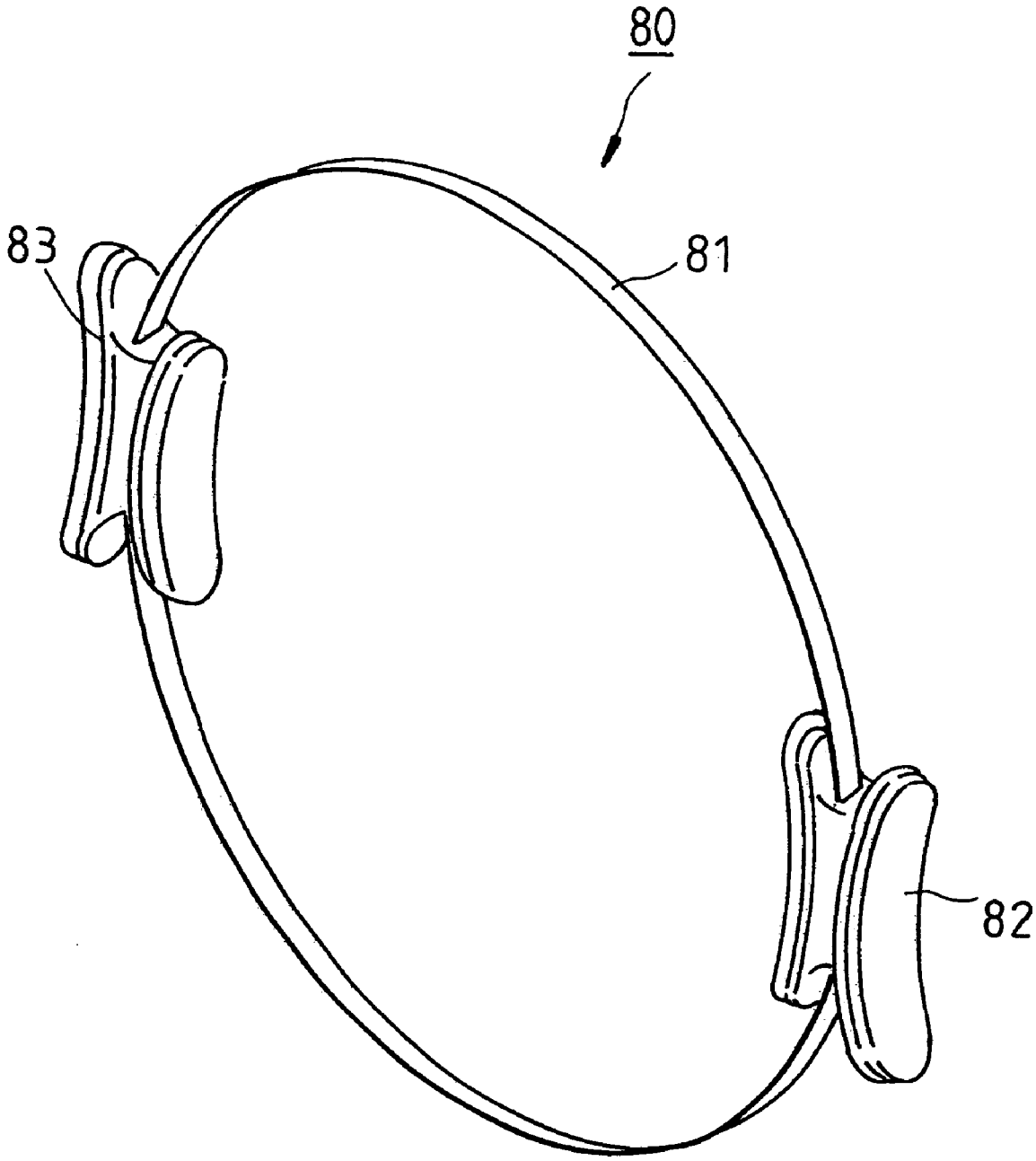
FIG. 6 PRIOR ART
FIG. 6 shows a conventional resilient exercise hoop.

Referring to FIGS. 3 and 5, while the user presses the two pressing portions 32 inwards, the resilient hoop body 20 is deformed to be elliptic in shape and the resilient bars 70 are extended outwards. In other words, the user has to exert a counterforce against both the resilience of the hoop body 20 and the resistance of the resilient bars 70 so as to deform the hoop body 20. Since each the resilient bar 70 can be detachably removed and installed, installing different numbers of the resilient bars 70 or removing all the resilient bars 70 and the connection seats 40 can regulate the whole intensity of the resistance of the hoop body 20. Briefly, a variety of difficulties for operating the exercise hoop 10 can be provided such that the exercise hoop 10 fits different users or different portions of their body to be exercised or different postures of them.

It's to be noted that the resistance member of the present invention can be made of other resilient materials or by a pneumatic cylinder, which is connected between the aforementioned position of the resilient hoop body. While the user presses the hoop body, the user has to resist not only the resilience of the hoop body but also the resistance generated by a piston rod of the pump as the piston rod is pulled outwards. The resistance of the piston rod can be regulated by the user as well, thereby the objective of the present invention can be achieved likewise.

What is claimed is:

1. An exercise hoop comprising:

a resilient hoop body having two pressing portions that face in opposite 5 directions for pressing to deform said resilient hoop body by the user, said resilient hoop body being circular under no external force and deformed to be elliptic while pressed by the external force but recovering its shape while the external force is eliminated; and a resistance member having two ends connected respectively to two predetermined opposite sides of said resilient hoop body between said two pressing portions of said resilient hoop body with resistance for preventing the two predetermined opposite sides from outward extension and deformation, said resistance of the resistance member being regulable for the user;

wherein said resistance member comprising predetermined numbers of resilient bars, each of said resilient bars being detachably connected to said resilient hoop body at two ends thereof;

wherein said resilient hoop body comprises two connection seats mounted respectively at two predetermined opposite sides thereof, each of said connection seats having a hook plate oriented toward an inner side of the resilient hoop body, said hook plate having predetermined numbers of positioning holes and gaps respectively extending outwards from fringes of said positioning holes toward fringes thereof, the width of said gap being smaller than the diameter of said positioning hole; wherein said resilient bar is provided with smaller diameter than the width of said gap and includes two head pieces respectively positioned at two ends thereof, each said head piece having a neck portion and a head portion extending from a distal end of said neck portion, said neck portion having smaller diameter than that of said positioning hole but having larger diameter than the width of said gap;

and wherein said resilient hoop body comprises two pair of indents respectively positioned at two edges of two predetermined opposite sides to which the connection seats are respectively mounted; wherein each said connection seat comprises a U-shaped clamping member, said clamping member having two through holes in communication with each other at two opposite sides thereof and an extension plate extending outwards from a side thereof, wherein said hook plate extends from an outer fringe of said extension plate, each said connection seat having said clamping member engaged with said pair of indents of said resilient hoop body; further comprising two fastening members, each said fastening member having a head portion, a body portion extending outwards from a distal end of said head portion, and a locking piece disposed inside a distal end of said body portion, said fastening members being inserted through said two through holes of said connection seat at said body portion and engaged against two sides of said clamping member at said head portion and said locking piece, said fastening member forcing said resilient hoop body inside said clamping member.

2. The exercise hoop as defined in claim 1, wherein said resistance member is a pneumatic cylinder.

* * * * *